US008497856B2

(12) United States Patent
Ota

(10) Patent No.: US 8,497,856 B2
(45) Date of Patent: Jul. 30, 2013

(54) LIGHT EMITTING DEVICE, METHOD OF DRIVING LIGHT EMITTING DEVICE, AND ELECTRONIC APPARATUS

(75) Inventor: Hitoshi Ota, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 373 days.

(21) Appl. No.: 13/028,711

(22) Filed: Feb. 16, 2011

(65) Prior Publication Data

US 2011/0205220 A1 Aug. 25, 2011

(30) Foreign Application Priority Data

Feb. 19, 2010 (JP) ..... 2010-034825

(51) Int. Cl.
*G09G 5/00* (2006.01)

(52) U.S. Cl.
USPC ..... 345/212; 345/211; 345/215; 315/169.1; 315/169.3

(58) Field of Classification Search
USPC ..... 345/211–215; 315/139.1–169.3
See application file for complete search history.

(56) References Cited

U.S. PATENT DOCUMENTS 7,525,522 B2 4/2009 Iida et al.
7,847,761 B2 * 12/2010 Yamamoto et al. ..... 345/76
8,314,756 B2 * 11/2012 Rankov et al. ..... 345/77
2007/0115225 A1 * 5/2007 Uchino et al. ..... 345/76
2008/0049007 A1 * 2/2008 Iida et al. ..... 345/211
2008/0143264 A1 * 6/2008 Minami et al. ..... 315/169.3
2008/0246403 A1 * 10/2008 Sagawa et al. ..... 315/35
2010/0013746 A1 * 1/2010 Seto ..... 345/76
2010/0060176 A1 * 3/2010 Takahashi et al. ..... 315/169.3
2010/0253710 A1 * 10/2010 Rankov et al. ..... 345/690

FOREIGN PATENT DOCUMENTS

JP 2008-122632 A 5/2008

* cited by examiner

*Primary Examiner* — Amare Mengistu
*Assistant Examiner* — Vinh Lam
(74) *Attorney, Agent, or Firm* — Oliff & Berridge, PLC

(57) ABSTRACT

A light emitting device includes a pixel circuit and a driving circuit, the pixel circuit including a driving transistor, a light emitting element, a first capacitance element interposed between a gate and a source of the driving transistor, a selection transistor, a current generating unit which generates set current. The driving circuit controls the current generating unit to generate set current with a predetermined magnitude in a current set period before a writing period of writing data potential in the pixel circuit, to set the voltage (voltage between both ends of the first capacitance element) between the gate and the source of the driving transistor to a value necessary to allow the set current to flow in the driving transistor.

15 Claims, 14 Drawing Sheets

(a1) PREFERAION PERIOD (a2) RESET PERIOD (b) CURRENT SET PERIOD (c) WRITING PERIOD (d) LIGHT EMITTING PERIOD (a) INITIALIZATION PERIOD (b) CURRENT SET PERIOD (c) WRITING PERIOD (d) LIGHT EMITTING PERIOD

LIGHT EMITTING DEVICE, METHOD OF DRIVING LIGHT EMITTING DEVICE, AND ELECTRONIC APPARATUS

This application claims priority to JP 2010-034825, filed in Japan on Feb. 19, 2010, the entire disclosure of which is herein incorporated by reference in its entirety.

BACKGROUND

1. Technical Field

The present invention relates to a light emitting device, a method of driving the light emitting device, and an electronic apparatus.

2. Related Art

Recently, various light emitting devices which employ light emitting elements such as organic EL (ElectroLuminescent) elements and organic light emitting diodes (hereinafter, referred to as "OLED") elements called light emitting polymer elements have been proposed.

For example, a light emitting device using a pixel circuit P0 shown in FIG. 20 is disclosed in JP-A-2008-122632. As shown in FIG. 20, the pixel circuit P0 has a driving transistor 3B and a light emitting element 3D which are connected in series between a supply line DSL101 and a ground line 3H, a sampling transistor 3A provided between a gate of the driving transistor 3B and a signal line DTL101, and a capacitance element 3C. The sampling transistor 3A is turned on according to a control signal supplied from a scanning line WSL101. A driving circuit (main scanner) driving the pixel circuit P0 performs a compensation operation during a plurality of horizontal scanning periods H prior to sampling of signal potential, to keep a voltage corresponding to a threshold voltage of the driving transistor 3B in the capacitance element 3C. Hereinafter, details thereof will be described with reference to FIG. 21.

The timing chart of FIG. 21 is divided into periods (B) to (L) according to transition of an operation of the pixel circuit P0. In the light emitting period (B), the light emitting element 3D is in a light emitting state. Thereafter, when the process enters the period (C), a new field period is started, the potential of the supply line DSL101 may be switched from high potential Vcc_H to low potential Vcc_L. In the low potential Vcc_L, since the voltage between both ends of the light emitting element 3B is set to a value less than a light emitting threshold voltage, the light emitting element 3D is in a non-light emitting state. Then, when the process proceeds to the period (D), a first horizontal scanning period H is started. In the period (D), the potential of the scanning line WSL101 is transited to the high level, and the potential of the signal line DTL101 is set to reference potential Vo. Accordingly, the potential of the gate of the driving transistor 3B is set to the reference potential Vo. Since the difference voltage between the reference potential Vo and the potential Vcc_L is set to a value sufficiently greater than the threshold voltage of the driving transistor 3B, potential of a source of the driving transistor 3B is set (initialized) to Vcc_L. Then, when the process proceeds to the compensation period (E), a first compensation operation is performed. More specifically, the potential of the supply line DSL 101 is set from the low potential Vcc_L to the high potential Vcc_H, the potential of the source of the driving transistor 3B starts rising, and the voltage between the gate and the source of the driving transistor 3B gradually approaches to the threshold voltage. Subsequently, when the process enters the period (F) of the latter half of the horizontal scanning period H, the potential of the signal line DTL101 is set to signal potential Vin. In this period (F), since the pixel circuit of the other line performs sampling of the signal potential Vin, the potential of the scanning line WSL101 is set to the low level, and the sampling transistor 3A is turned off.

Then, when a second horizontal scanning period H is started, the first half thereof becomes the compensation period (G) again, the potential of the signal line DTL101 is set to the reference potential Vo, the potential of the scanning line WSL101 is set to the high level, and a second compensation operation is performed. In the latter half period (H), since the pixel circuit of the other line performs sampling, the potential of the signal line DTL101 is set to the signal potential Vin, and the potential of the scanning line WSL101 is set to the low level. Then, when a third horizontal scanning period H is started, the first half thereof becomes the compensation period (I) again, a third compensation operation is performed. Subsequently, when the process proceeds to the period (J), the potential of the signal line DTL101 is set to the signal potential Vin. When the process proceeds to the sampling period (K), the potential of the scanning line WSL101 is set to the high level, the sampling transistor 3A is turned on, the gate potential of the driving transistor 3B is set to the signal potential Vin. Accordingly, since current flows into capacitance corresponding to the OLED element 3D according to the signal potential Vin, the potential of the source of the driving transistor 3B rises, and a mobility compensation operation is performed by negative feedback. Thereafter, when the process enters the light emitting period (L), the potential of the scanning line WSL101 is set to the low level, the sampling transistor 3A is turned off, and the gate of the driving transistor 3B enters an electrically floating state. The current corresponding to the voltage between both ends of the capacitance element 3C flows in the driving transistor 3B, the potential of the source of the driving transistor 3B rises, and the potential of the gate of the driving transistor 3B rises according to the potential of the source (bootstrap operation). When the potential of the source of the driving transistor 3B is higher than the light emitting threshold value, the light emitting element 3D emits light.

However, in the JP-A-2008-122632, the compensation operation is performed during the plurality of horizontal scanning periods H prior to the sampling of the signal potential Vin, and thus a length of time of the light emitting period becomes shorter. Accordingly, in the technique disclosed in JP-A-2008-122632, there is a problem that it is difficult to sufficiently secure the length of time of the light emitting period.

SUMMARY

An advantage of some aspects of the invention is to shorten the time necessary to set the voltage between the gate and the source of the driving transistor just before the data writing period to a desired value and to sufficiently secure the length of time of the light emitting period.

According to an aspect of the invention, there is provided a light emitting device including: a pixel circuit; and a driving circuit that drives the pixel circuit, wherein the pixel circuit includes a driving transistor and a light emitting element that are connected in series between a high potential supply line and a low potential supply line, a first capacitance element that is provided between a gate and a source of the driving transistor, a selection transistor that is provided between the gate of the driving transistor and a data line, and a current generating unit that generates a set current passing from the high potential supply line through the driving transistor and a node interposed between the driving transistor and the light emitting element, and flowing to be branched into the other path different from a path reaching the light emitting element, and wherein the driving circuit in a first period (initialization period PRS), sets the potential of the gate of the driving transistor to the initialization potential to turn on the driving transistor, in a second period (current set period PS) after the first period, controls the current generating unit to generate the set current with a predetermined magnitude to set the voltage between both ends of the first capacitance element to a value necessary for the set current to flow in the driving transistor, and in a third period (writing period PWR) after the second period, sets the selection transistor to be turned on and sets the potential output to the data line to data potential corresponding to a designated gradation of the light emitting element to set the voltage between both ends of the capacitance element to a value corresponding to the data potential.

Herein, a case (hereinafter, referred to as "a related example") is assumed in which the voltage between the gate and the source of the driving transistor just before the date writing period is set to threshold voltage of the driving transistor. In the related example, in the period (compensation period) before the data writing period, the driving circuit allows a current to flow in the driving transistor with the potential of the gate of the driving transistor kept in a predetermined value, such that the voltage between the gate and the source of the driving transistor gradually approaches to the threshold voltage. However, as the voltage between the gate and the source of the driving transistor approaches to the threshold voltage, the current flowing in the driving transistor becomes a very small value, and a time rate of change of the voltage between the gate and the source of the driving transistor also becomes very small. Accordingly, until the value of the current flowing in the driving transistor securely becomes zero (the voltage between the gate and the source of the driving transistor securely reaches the threshold voltage), a very long time is necessary. For this reason, in the related example, it is difficult to sufficiently secure the length of time of the light emitting period. On the contrary, in the aspect of the invention, in the second period just before the data writing period (third period), the driving circuit controls the current generating unit to generate the set current with the predetermined magnitude, to set the voltage (voltage between both ends of the first capacitance element) between the gate and the source of the driving transistor to a value necessary to allow the set current to flow in the driving transistor. Accordingly, it is possible to drastically shorten the length of time necessary to set the voltage between the gate and the source of the driving transistor just before the data writing period to a desired value, as compared with the related example. As a result, according to the aspect of the invention, there is an advantage that it is possible to sufficiently secure the length of time of the light emitting period as compared with the related example.

In the light emitting device according to the aspect of the invention, the current generating unit is provided with a second capacitance element including a first electrode and a second electrode and with a supply line, the first electrode is connected to the node, and the second electrode is connected to the supply line, and in the second period, the driving circuit changes the potential output to the supply line with the passage of time to allow the set current with a predetermined magnitude to flow in the driving transistor. In the aspect, the set current becomes a value corresponding to the time rate of change of the potential output to the supply line. For example, when the potential output to the supply line changes linearly at a constant time rate of change, the value of the set current becomes constant, and the voltage between both ends of the first capacitance element is set to a value necessary to allow the set current (the constant value) to flow in the driving transistor. According to the aspect, there is an advantage that it is easy to adjust the voltage between the gate and the source of the driving transistor to a desired value, as compared with the aspect in which the value of the set current flowing in the driving transistor in the second period is changed. As a light emitting device according to another aspect of the invention, the current generating unit may be formed of a constant current source.

The light emitting device according to the aspect of the invention is used in various electronic apparatuses. A general example of the electronic apparatus is an apparatus using the light emitting device as a display device. A personal computer or a mobile phone is an example of the electronic apparatus according to the aspect of the invention. First of all, the use of the light emitting device according to the aspect of the invention is not limited to displaying an image. For example, the light emitting device according to the aspect of the invention is also applied to an exposure device (optical head) for forming a latent image by illumination of light on an image carrying body such as a photosensitive drum.

According to another aspect of the invention, there is provided a method of driving a pixel circuit provided with a driving transistor and a light emitting element that are connected in series between a high potential supply line and a low potential supply line, and a first capacitance element provided between a gate and a source of the driving transistor, the method including: in a first period, setting potential of the gate of the driving transistor to initialization potential to turn on the driving transistor, in a second period after the first period, generating set current with a predetermined magnitude passing from the high potential supply line through the driving transistor and a node interposed between the driving transistor and the light emitting element, and flowing to be branched into the supply line, to set the voltage between both ends of the first capacitance element to a value in which the set current flows in the driving transistor, and in a third period after the second period, setting the potential of the gate of the driving transistor to potential corresponding to a designated gradation of the light emitting element. Also, according to the driving method, it is possible to obtain the same advantage as the light emitting device according to the aspect of the invention.

BRIEF DESCRIPTION OF THE DRAWINGS

The invention will be described with reference to the accompanying drawings, wherein like numbers reference like elements.

DETAILED DESCRIPTION OF EMBODIMENTS

A: First Embodiment

Figure 1:
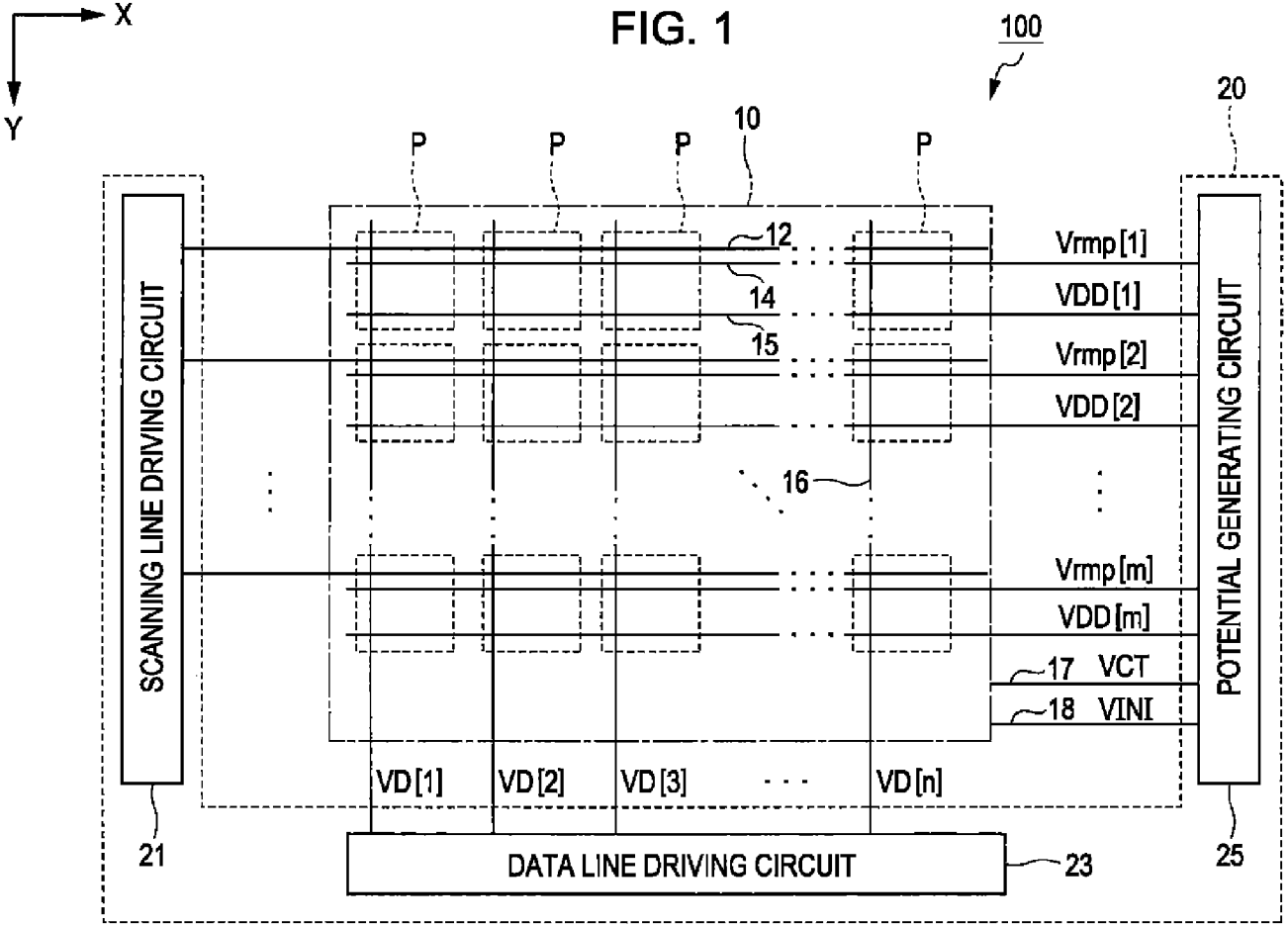
FIG. 1 is a block diagram illustrating a light emitting device according to a first embodiment of the invention.

FIG. 1 is a block diagram illustrating a schematic configuration of a light emitting device 100 according to a first embodiment of the invention. The light emitting device 100 is mounted as a display device displaying an image on an electronic apparatus. As shown in FIG. 1, the light emitting device 100 includes an element portion (display area) 10 in which a plurality of pixel circuits P are arranged, and a driving circuit 20 driving each of the pixel circuits P. The driving circuit 20 includes a scanning line driving circuit 21, a data line driving circuit 23, and a potential generating circuit 25. For example, the driving circuit 20 is dispersedly mounted on a plurality of integrated circuits. However, at least a part of the driving circuit 20 may be formed of a thin-film transistor formed on a substrate with the pixel circuits P.

In the element portion 10, m sets of line groups 12 extending in an X direction, m supply lines 14 and high potential supply lines 15 corresponding to the line groups 12 and extending in the X direction, n data lines 16 extending in the Y direction intersecting with the X direction are formed (m and n are natural numbers). The plurality of pixel circuits P are provided at the intersections between the sets of the line groups 12, the supply lines 14, and the high potential supply lines 15, and the data lines 16, and are arranged in a matrix of m rows×n columns.

The scanning line driving circuit 21 is a unit sequentially selecting the plurality of pixel circuits P by a row unit. The data line driving circuit 23 generates data potential VD (VD[1] to VD[n]) corresponding to gradations (hereinafter, referred to as "designated gradation") designated for the pixel circuits P, and outputs the gradations to the data lines 16. In a horizontal scanning period when the i-th row (i=1 to m) is selected, the data potential VD[j] output to the j-th (j=1 to n) data line 16 is set to a potential corresponding to the designated gradation of the pixel circuit P positioned at the j-th position of the i-th row.

The potential generating circuit 25 generates high potential VDD of a power supply, low potential VCT of the power supply, ramp potential Vrmp, and initialization potential VINI. The potential generating circuit 25 outputs the ramp potential Vrmp to the supply lines 14. The ramp potential output to the supply line 14 of the i-th row is represented by Vrmp[i]. The potential generating circuit 25 outputs the high supply potential VDD to the high potential supply line 15. The supply potential VDD output to the high potential supply line 15 of the i-th row is represented by VDD[i]. The low supply potential VCT is commonly supplied to the pixel circuits P through a low potential supply line 17. The initialization potential VINI is commonly supplied to the pixel circuits P through an initialization line 18.

Figure 2:
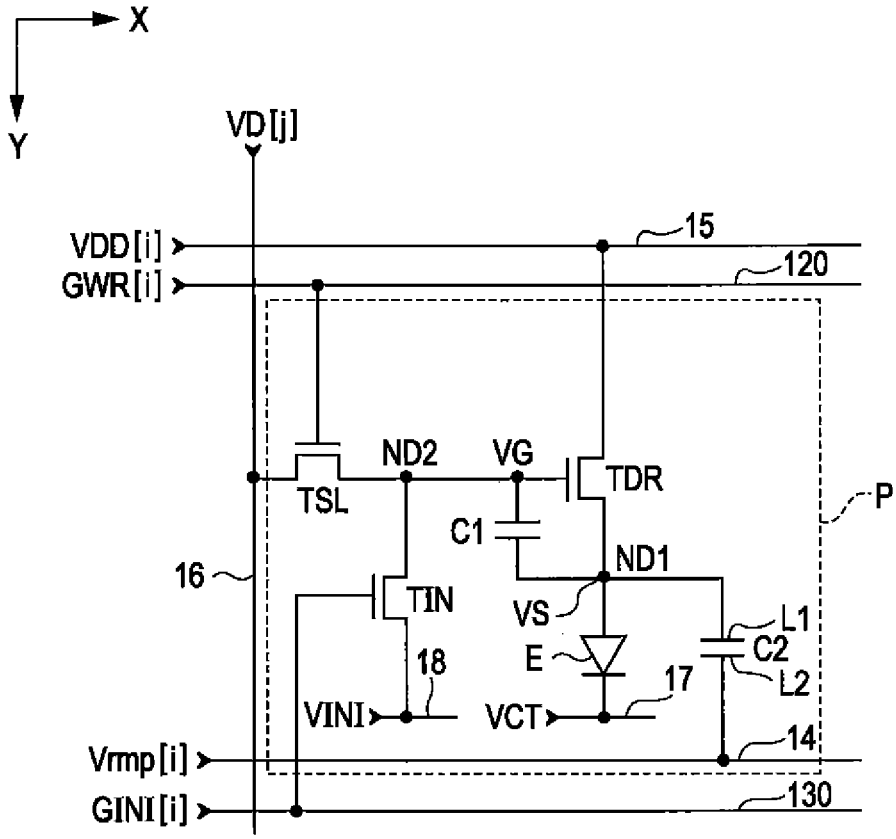
FIG. 2 is a circuit diagram illustrating a pixel circuit.

FIG. 2 is a circuit diagram illustrating the pixel circuit P. In FIG. 2, only one pixel circuit P position at the j-th position of the i-th row is representatively shown. As shown in FIG. 2, the pixel circuit P includes a light emitting element E, a driving transistor TDR, a first capacitance element C1, a second capacitance element C2, and a plurality of transistors (TSL and TIN). The line group 12 shown as one straight line in FIG. 1 includes a scanning line 120 and a control line 130 as shown in FIG. 2.

The light emitting element E is provided on a path connecting the high potential supply line 15 of the i-th row to the low potential supply line 17 which is common for the pixel circuits P of the rows, and emits light by brightness corresponding to the current value of the driving current generated by the driving transistor TDR. The light emitting element E is an OLED element in which a light emitting layer formed of an organic EL material is interposed between an anode and a cathode opposed to each other. The cathode of the light emitting element E is connected to the low potential supply line 17.

The driving transistor TDR is a N-channel thin-film transistor connected in series to the light emitting element E on the path connecting the high potential supply line 15 of the i-th row to the low potential supply line 17 which is common for the pixel circuits P of the rows. The driving transistor TDR generates driving current of a current value corresponding to voltage VGS (=VG−VS) of difference between potential VG of the gate and potential VS of the source of the driving transistor TDR. The source of the driving transistor TDR is connected to the anode of the light emitting element E.

The first capacitance element C1 is interposed between the gate and the source of the driving transistor TDR. The second capacitance element C2 is interposed between the a first node ND1 (corresponding to the source of the driving transistor TDR) interposed between the driving transistor TDR and the light emitting element E on the path connecting the high potential supply line 15 and the low potential supply line 17 of the i-th row, and the supply line 14 of the i-th row. The second capacitance element C2 includes a first electrode L1 connected to the first node ND1 and a second electrode L2 connected to the supply line 14 of the i-th row.

The selection transistor TSL is provided between the gate of the driving transistor TDR and the data line 16 of the j-th column. As the selection transistor TSL, for example, an N-channel transistor (thin-film transistor) is very appropriately employed. The gate of the selection transistor TSL of each of the n pixel circuits P belonging to the i-th row is commonly connected to the scanning line 120 of the i-th row.

The initialization transistor TIN is provided between the second node ND2 interposed between the gate of the driving transistor TDR and the selection transistor TSL, and the initialization line 18. As the initialization transistor TIN, for example, an N-channel transistor (thin-film transistor) is very appropriately employed. The gate of the initialization transistor TIN of each of the pixel circuits P of the i-th row is commonly connected to the control line 130 of the i-th row.

Figure 3:
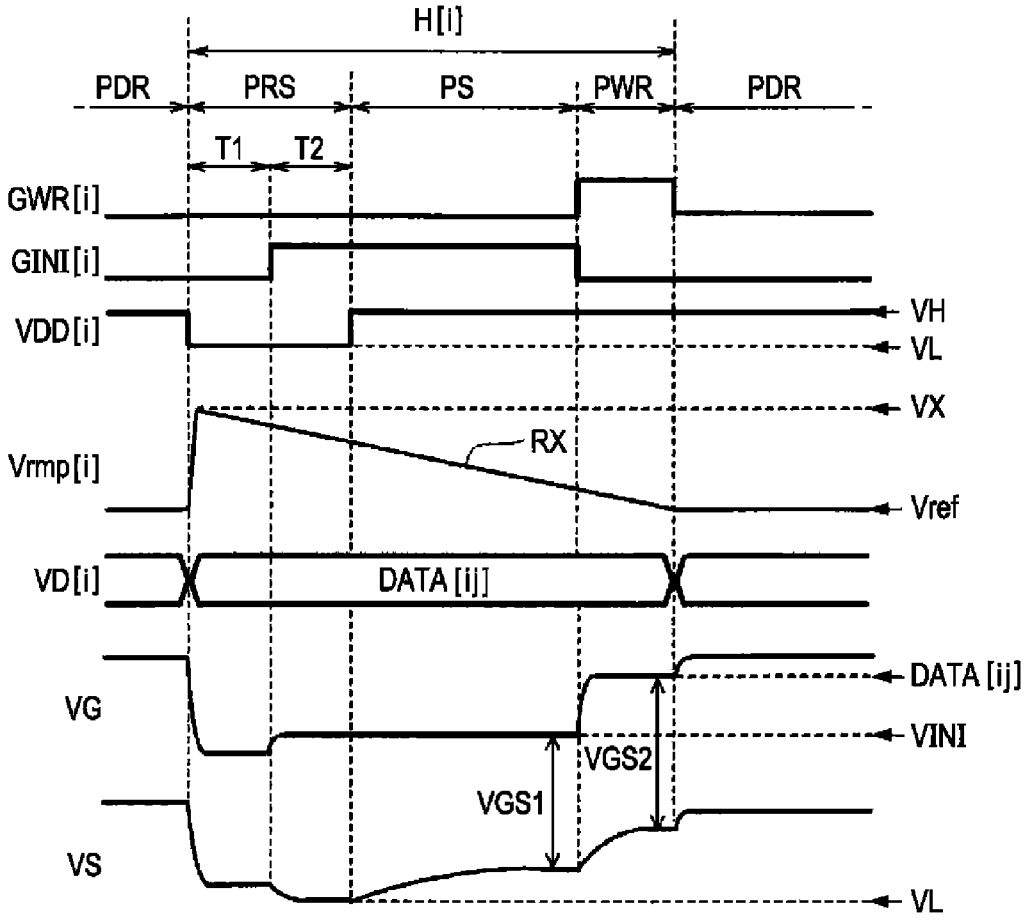
FIG. 3 is a timing chart illustrating an operation of the pixel circuit.

The scanning line driving circuit 21 shown in FIG. 1 generates a scanning signal GWR[i] for sequentially scanning (selecting) the plurality of pixel circuits P by a row unit, and outputs them to the scanning lines 120. As shown in FIG. 3, the scanning signal GWR[i] output to the scanning line 120 of the i-th row is set to an active level (high level) in the writing period PWR in the i-th horizontal scanning period H[i] in each vertical scanning period. When the scanning signal GWR[i] is transited to the high level, the selection transistors TSL of the n pixel circuits P belonging to the i-th row are turned on all at once. The scanning line driving circuit 21 generates and outputs a control signal GINI[i]. As shown in FIG. 2, the control signal GINI[i] is supplied to the control line 130 of the i-th row. The data line driving circuit 23 shown in FIG. 1 generates data potential VD[1] to VD[n] corresponding to the pixel circuits P of the one row (n) selected by the scanning line driving circuit 21 in each horizontal scanning period H, and outputs the data potential to the data lines 16. The data potential VD[j] output to the data line 16 of the j-th column in the horizontal scanning period H[i] in which the i-th row is selected becomes potential DATA[i, J] corresponding to the designated gradation of the pixel circuit P positioned at the j-th position of the i-th row.

Next, paying attention to the j-th pixel circuit P of the i-th row, an operation (method of driving the pixel circuit P) of the driving circuit 20 will be described with reference to FIG. 3. As shown in FIG. 3, the horizontal scanning period H[i] includes an initialization period PRS, a current set period PS, and a writing period PWR. A period until the i-th horizontal scanning period H[i] in any vertical scanning period is ended and then the i-th horizontal scanning period H[i] in the next vertical scanning period is started is set to a light emitting period PDR. Hereinafter, an operation of the j-th pixel circuit P belonging to the i-th row will be described by division into the initialization period PRS, the current set period PS, the writing period PWR, and the light emitting period PDR.

(a) Initialization Period PRS

Figure 4:
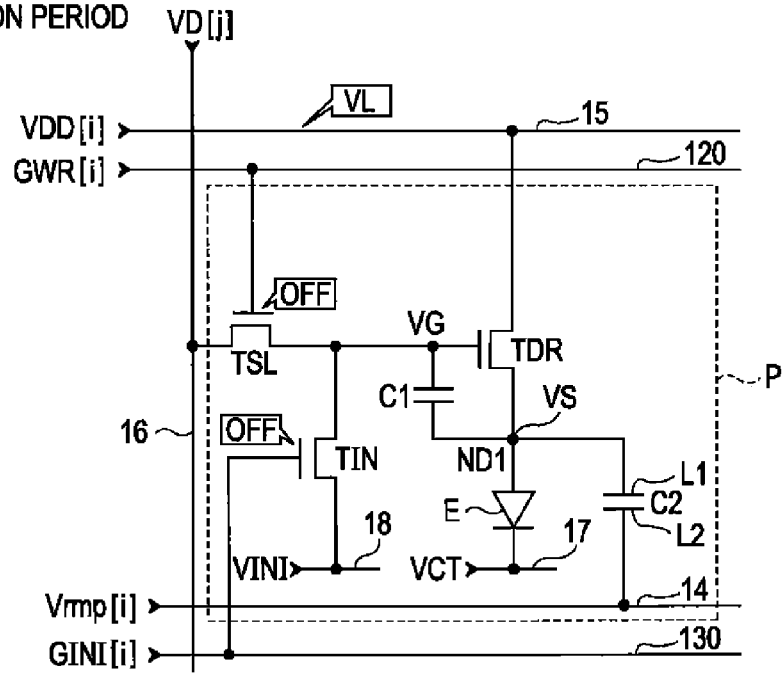
FIG. 4 is a diagram illustrating an operation of the pixel circuit at a preparation period.

As shown in FIG. 3, the initialization period PRS is divided into a preparation period T1 and a reset period T2 just after the preparation period T1. First, an operation of the pixel circuit P in the preparation period T1 will be described. As shown in FIG. 3, when the preparation period T1 is started, the driving circuit 20 (e.g., the scanning line driving circuit 21) sets the scanning signal GWR[i] and the control signal GINI[i] to an inactive level (low level). Accordingly, as shown in FIG. 4, the selection transistor TSL and the initialization transistor TIN are set to be turned off. As shown in FIG. 3, the driving circuit 20 (the potential generating circuit 25) sets the supply potential VDD[i] output to the high potential supply line 15 to the low potential VL of the i-th row. Accordingly, the potential VS of the source of the driving transistor TDR is transited to potential close to the low potential VL. In the embodiment, the low potential VL is set to a value such that the voltage (voltage between the first node ND1 and the low potential supply line 17) between both ends of the light emitting element E in the preparation period T1 is less than a light emitting threshold voltage Vth_el. That is, in the preparation period T1, the light emitting element E is in the non-light emitting state.

Figure 5:
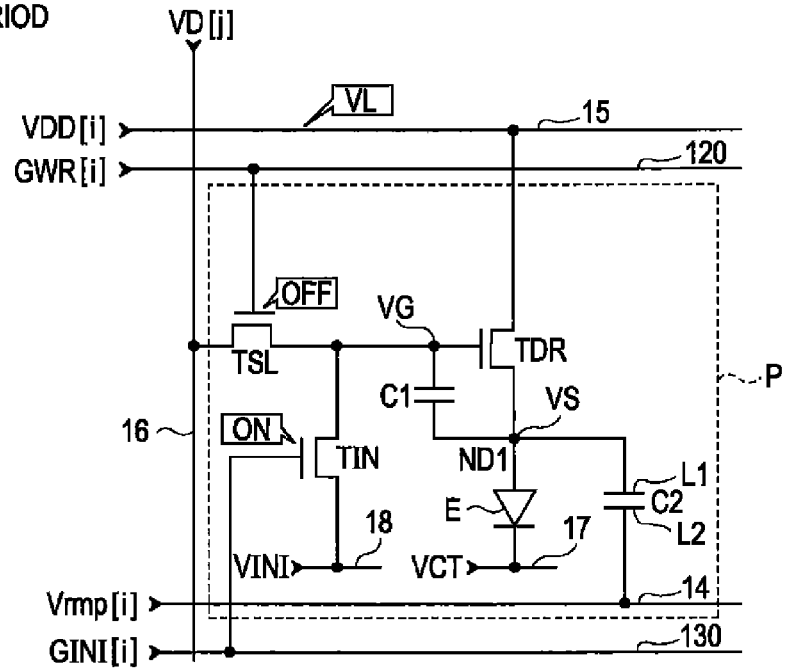
FIG. 5 is a diagram illustrating an operation of the pixel circuit at a reset period.

Next, an operation of the pixel circuit P in the reset period T2 will be described. As shown in FIG. 3, when the reset period T2 is started, the driving circuit 20 (e.g., the scanning line driving circuit 21) keeps the scanning signal GWR[i] in the low level, and sets the control signal GINI[i] to the active level (high level). Accordingly, as shown in FIG. 5, the initialization transistor TIN is turned on. The gate of the driving transistor TDR is electrically connected to the initialization line 18 through the initialization transistor TIN, the potential VG of the gate of the driving transistor TDR is set to the initialization potential VINI supplied to the initialization line 18. As shown in FIG. 3 and FIG. 5, the driving circuit 20 (the potential generating circuit 25) keeps the value of the supply potential VDD[i] output to the high potential supply line 15 of the i-th row in the low potential VL. In the embodiment, since the voltage of the difference between the initialization potential VINI and the low potential VL is set to be higher than the threshold voltage VTH of the driving transistor TDR, the driving transistor TDR in the reset period T2 is turned on, the potential VS of the driving transistor TDR is set to the low potential VL. That is, the voltage VGS (voltage between both ends of the first capacitance element C1) between the gate and the source of the driving transistor TDR is initialized to the voltage (|VINI−VL|) of the difference between the initialization potential VINI and the low potential VL.

(b) Current Set Period PS

Figure 6:
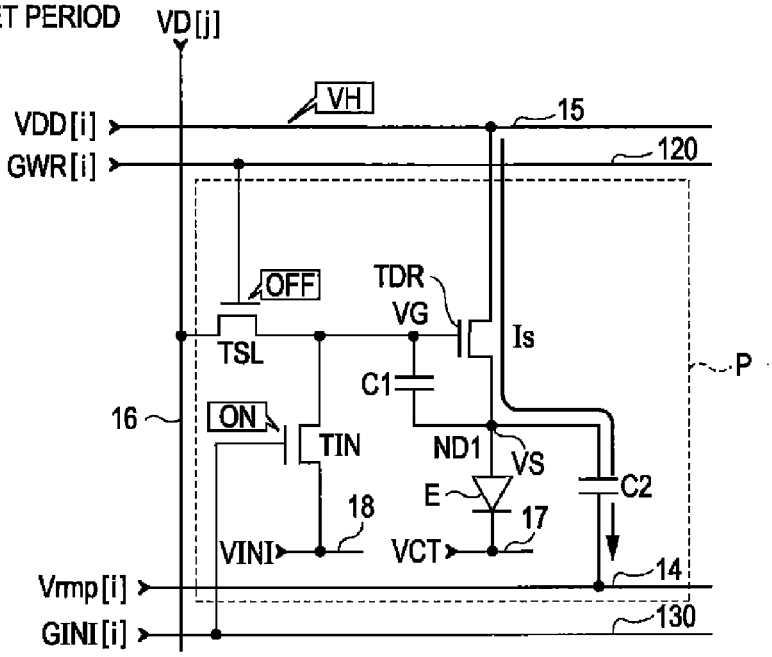
FIG. 6 is a diagram illustrating an operation of the pixel circuit at a current set period.

As shown in FIG. 3 and FIG. 6, when the current set period PS is started, the driving circuit 20 (the potential generating circuit 25) sets the value of the supply potential VDD[i] output to the high potential supply line 15 of the i-th row to the high potential VH. Accordingly, the current from the high potential supply line 15 of the i-th row flows in the driving transistor TDR, and the potential VS of the source of the driving transistor TDR starts rising. Since the potential VG of the gate of the driving transistor TDR is kept in the initialization potential VINI, the voltage between the gate and the source of the driving transistor TDR gradually decreases. At this time, the driving circuit 20 (the potential generating circuit 25) changes the ramp potential Vrmp[i] output to the supply line 14 of the i-th row with the passage of time, to generate set current Is with a predetermined magnitude passing from the high potential supply line 15 of the i-th row through the first node ND1 and flowing to be branched into a path different from the path reaching the light emitting element E. More details are as follows.

As shown in FIG. 3, when the horizontal scanning period H[i] is started, the potential generating circuit 25 sets the ramp potential Vrmp[i] output to the supply line 14 of the i-th row from the reference potential Vref to the start potential VX (<Vref). From the start point to the end point of the horizontal scanning period H[i], the ramp potential Vrmp[i] is linearly decreased at a time rate of change RX (RX=dVrmp/dt). In the embodiment, the potential generating circuit 25 linearly decreases the ramp potential Vrmp[i] such that the value of the ramp potential Vrmp[i] at the end point of the horizontal scanning period H[i] is equal to the reference potential Vref. When the capacitance of the second capacitance element C2 is represented by Cp and charges accumulated in the second capacitance element C2 are represented by Q, the set current Is flowing in the supply line 14 of the i-th row from the high potential supply line 15 of the i-th row through the first node ND1 and the second capacitance element C2 in the current set period PS is represented by the following formula (1).

$$Is=dQ/dt=Cp\times dVrmp/dt=Cp\times RX \quad (1)$$

In the embodiment, since the time rate of change RX of the ramp potential Vrmp is constant, the value of the set current Is is constant. Accordingly, in the current set period PS, the voltage between the gate and the source of the driving transistor TDR gradually approaches to the voltage VGS1 necessary for the constant set current Is to flow in the driving transistor TDR. That is, in the current set period PS, the operation allowing the voltage between the gate and the source of the driving transistor TDR to gradually approach to the voltage VGS1 is performed. In the embodiment, the voltage VGS1 is represented by the following formula (2).

$$VGS1=VTH+Va \quad (2)$$

Since the voltage between the gate and the source of the driving transistor TDR is set to the voltage necessary for the constant set current Is to flow in the driving transistor TDR, it is possible to compensate for the irregularity of characteristics (particularly, the threshold voltage VTH) of each driving transistor TDR to be described later.

At the end point of the current set period PS, since the voltage between the gate and the source of the driving transistor TDR is substantially equal to the voltage VGS1 necessary for the constant set current Is to flow in the driving transistor TDR, the potential VS of the source of the driving transistor TDR is set to the potential VINI−VGS1 lower than the initialization potential VINI (the potential VG of the gate) by the voltage VGS1. In the embodiment, the potential difference between (voltage between both ends of the light emitting element E) the potential VINI-VGS1 and the low supply potential VCT is set to be lower than the light emitting threshold voltage Vth_el of the light emitting element E. That is, even in the current set period PS, the light emitting element E is in the non-light emitting state.

(c) Writing Period PWR

Figure 7:
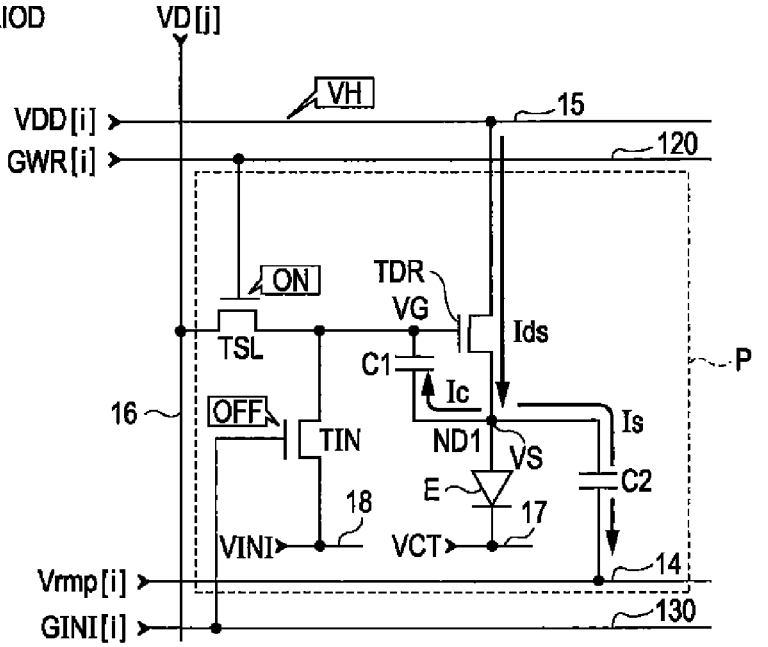
FIG. 7 is a diagram illustrating an operation of the pixel circuit at a writing period.

As shown in FIG. 3, when the writing period PWR is started, the driving circuit 20 (e.g., the scanning line driving circuit 21) sets the scanning signal GWR[i] to the high level, and sets the control signal GINI[i] to the row level. The high potential supply potential VDD[i] output to the high potential supply line 15 of the i-th row is kept in the high potential VH. Accordingly, as shown in FIG. 7, the selection transistor TSL is turned on, the initialization transistor TIN is turned off, and thus the gate of the driving transistor TDR is electrically connected to the data line 16 of the j-th column. Accordingly, the potential VG of the gate of the driving transistor TDR is set to the data potential VD[j] (DATA[I, j]), and the current Ids corresponding to the data potential VD[j] flows in the driving transistor TDR. When the current Ids flows in the driving transistor TDR, the potential VS of the source of the driving transistor TDR rises with the passage of time, and thus the voltage between the gate and the source of the driving transistor TDR is decreased with the passage of time.

At this time, the driving circuit 20 (the potential generating circuit 25) linearly decreases the ramp potential Vrmp[i] output to the supply line 14 of the i-th row at the time rate of change RX in the same manner as the current set period PS, and thus the constant set current Is continues to flow on the path reaching the supply line 14 of the i-th row from the first node ND1 through the second capacitance element C2. Then, the current Ids flowing in the driving transistor TDR is branched into the set current Is flowing toward the second capacitance element C2 and the current Ic (Ids−Is) flowing toward the first capacitance element C1, for the first node ND1. As described above, since the value of the set current Is is constant, the value of the current Ic flowing in the first capacitance element C1 increases to the extent the value of the current Ids corresponding to the data potential VD[j] gets larger. As a result, the rising amount (i.e., the amount of decrease in the voltage between the gate and the source) of the potential of the source of the driving transistor TDR also gets larger.

As mobility μ of the driving transistor TDR gets larger, the value of the current Ids flowing in the driving transistor TDR gets larger, and the rising amount of the potential VS of the source gets larger. On the contrary, as the mobility μ gets smaller, the value of the current Ids flowing in the driving transistor TDR gets smaller. That is, as the mobility μ gets larger, the amount of decrease (negative feedback amount) in the voltage between the gate and the source of the driving transistor TDR gets larger. When the mobility μ gets smaller, the amount of decrease (negative feedback amount) in the voltage between the gate and the source gets smaller. Accordingly, the irregularity of the mobility μ for each pixel circuit P is compensated for. Such a mobility compensation operation is performing during the entire period of the writing period PWR, the voltage VGS2 (voltage between both ends of the first capacitance element C1) between the gate and the source of the driving transistor TDR at the end point of the writing period PWR is set to a value to which the data potential VD[j] and the characteristic (mobility μ) of the driving transistor TDR are applied. The voltage VGS2 between the gate and the source of the driving transistor TDR at the end point of the writing period PWR is represented by the following formula (3).

$$VQS2=VGS1+\Delta V=VTH+Va+\Delta V \quad (3)$$

The ΔV in the formula (3) is a value corresponding to the data potential VD[j] and the characteristics (mobility μ) of the driving transistor TDR. In addition, the potential VS of the source of the driving transistor TDR at the end point of the writing period PWR is set to a value such that the voltage between both ends of the light emitting element E is less than the light emitting threshold voltage Vth_el. Accordingly, also in the writing period PWR, the light emitting element E is in the non-light emitting state.

(d) Light Emitting Period PDR

Figure 8:
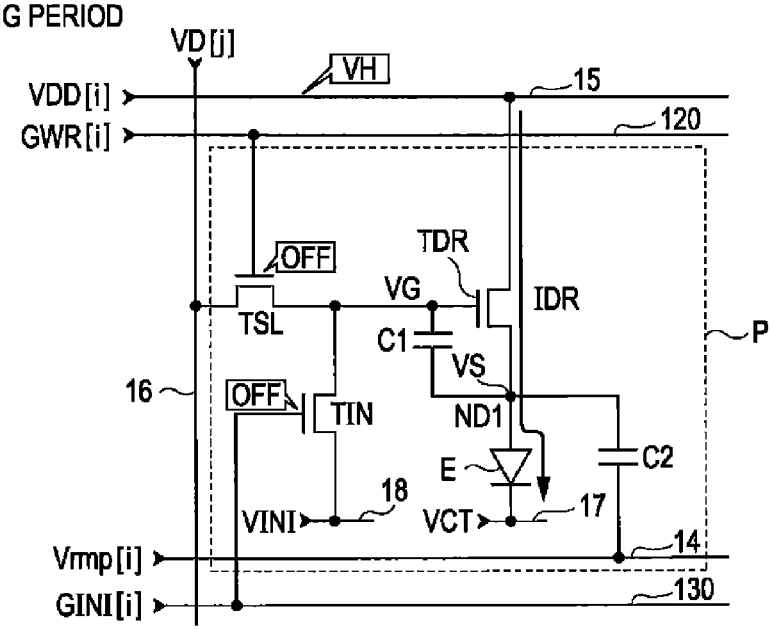
FIG. 8 is a diagram illustrating an operation of the pixel circuit at a light emitting period.

As shown in FIG. 3, when the light emitting period PDR is started, the driving circuit 20 (e.g., the scanning line driving circuit 21) sets the scanning signal GWR[i] to the low level. The driving circuit 20 (the potential generating circuit 25) sets the ramp potential Vrmp[i] output to the supply line 14 of the i-th row to the constant reference potential Vref. The same level as the writing period PWR is kept for the other signals. Accordingly, as shown in FIG. 8, the selection transistor TSL is turned off, and the gate of the driving transistor TDR enters an electrical floating state. Since the driving circuit 20 sets the ramp potential Vrmp[i] output to the supply line 14 of the i-th row to the constant reference potential Vref, the value of the set current Is becomes zero as can be seen from the formula (1).

At this time, since the voltage (voltage between the gate and the source of the driving transistor TDR) between both ends of the first capacitance element C1 is kept in the voltage VGS2 at the end point of the writing period PWR, the current Tel corresponding to the voltage VGS2 flows in the driving transistor TDR and the potential VS of the source rises with the passage of time.

Since the gate of the driving transistor TDR is in the electrical floating state, the potential VG of the gate of the driving transistor TDR rises according to the potential VS of the source. The potential VS of the source of the driving transistor TDR gradually increases in the state where the voltage between the gate and the source of the driving transistor TDR is kept in the voltage VGS2 set at the end point of the writing period PWR. When the voltage between both ends of the light emitting element E reaches the light emitting threshold voltage Vth_el, the current Iel flows in the light emitting element E as driving current. The light emitting element E emits light by brightness corresponding to the driving current Tel.

Assuming that the driving transistor TDR operates in a saturation area, the driving current Iel is represented by the following formula (4). "β" is a gain coefficient of the driving transistor TDR.

$$Iel=(\beta/2)(VGS2-VTH)^2 \quad (4)$$

The formula (4) is modified as follows by substitution of the formula (3).

$$Iel = (\beta/2)(VTH + Va + \Delta V - VTH)^2$$
$$= (\beta/2)(Va + \Delta V)^2$$

That is, the driving current Iel does not depend on the threshold voltage VTH of the driving transistor TDR, and thus irregularity of brightness caused by the irregularity of the threshold voltage VTH for each pixel circuit P is suppressed.

Herein, a case (the related example) where the voltage between the gate and the source of the driving transistor TDR just before the writing period PWR is set to the threshold voltage VTH of the driving transistor TDR is assumed. In the related example, the driving circuit 20 (e.g., the scanning line driving circuit 21) allows the current to flow in the driving transistor TDR in the state where the potential VG of the gate of the driving transistor TDR is kept in a predetermined value in the period (compensation period) prior to the writing period PWR, and thus the voltage between the gate and the source of the driving transistor TDR gradually approaches to the threshold voltage VTH. However, as the voltage between the voltage between the gate and the source of the driving transistor TDR gets closer to the threshold voltage VTH, the current flowing in the driving transistor TDR becomes a small value, and the time rate of change of the voltage between the gate and the source of the driving transistor TDR becomes very small. Accordingly, until the value of the current flowing in the driving transistor TDR securely becomes zero (until the voltage between the gate and the source of the driving transistor TDR securely reaches the threshold voltage VTH), a very long time is necessary. For this reason, there is a problem that it is difficult to sufficiently secure the length of time of the light emitting period PDR in the related art.

On the contrary, in the embodiment described above, in the current set period PS just before the writing period PWR, the driving circuit 20 changes the ramp potential Vrmp[i] output to the supply line 14 of the i-th row with the passage of time such that the set current Is with a predetermined magnitude flows in the driving transistor TDR, to set the voltage (voltage between both ends of the first capacitance element C1) between both ends of the driving transistor TDR to a value necessary for the set current Is with the predetermined magnitude to flow in the driving transistor TDR. Accordingly, it is possible to drastically shorten the length of time necessary to set the voltage between the gate and the source of the driving transistor TDR to a desired value just before the writing period PWR, as compared with the related example. As a result, according to the embodiment, there is an advantage that it is possible to sufficiently secure the length of time of the light emitting period PDR as compared with the related example.

B: Second Embodiment

The second embodiment is different from the first embodiment in that the driving transistor TDR of each pixel circuit P is formed of a P-channel transistor. In the second embodiment, the same reference numerals and signs as the first embodiment are given to elements having the same operation and function as the first embodiment, and the detailed description thereof is appropriately omitted.

Figure 9:
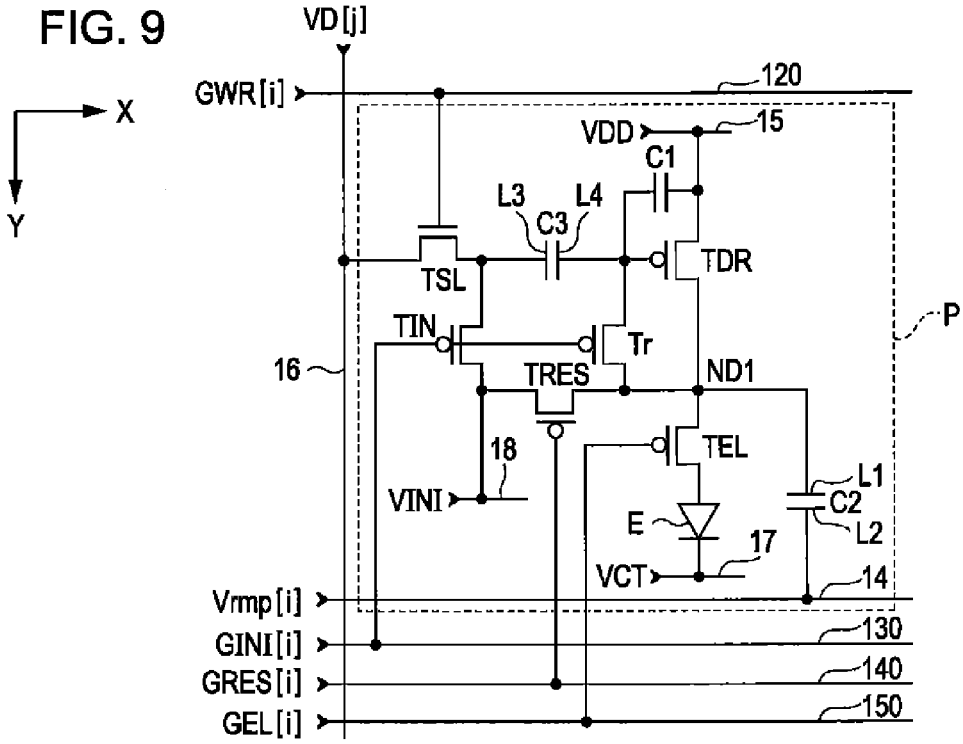
FIG. 9 is a circuit diagram illustrating a pixel circuit according to a second embodiment of the invention.

FIG. 9 is a circuit diagram illustrating the pixel circuit P. In FIG. 9, only one pixel circuit P position at the j-th position of the i-th row is representatively shown. As shown in FIG. 9, the pixel circuit P includes a light emitting element E, a driving transistor TDR, a first capacitance element C1, a second capacitance element C2, a third capacitance element C3, a plurality of transistors (TSL, TIN, TRES, Tr, and TEL). The driving transistor TDR and the transistors (TIN, TRES, Tr, and TEL) other than the selection transistor TSL are formed of P-channel transistors. The line group 12 shown by one straight line in FIG. 1 includes a scanning line 120, a control line 130, a reset control line 140, and a light emitting control line 150 as shown in FIG. 9. The scanning line driving circuit 21 generates a reset signal GRES[i] and outputs them to the reset control lines 140. The reset signal output to the reset control line 140 of the i-th row is represented by GRES[i]. The scanning line driving circuit 21 generates a light emitting control signal GEL[i] and outputs them to the light emitting control lines 150. The light emitting control signal output to the light emitting control line 150 of the i-th row is represented by GEL[i]. The high supply potential VDD is set to a constant value, there is a difference from the first embodiment in that the high supply potential VDD is commonly supplied to the pixel circuits P of the rows through the high potential supply line 15.

As shown in FIG. 9, On the current path from the high potential supply line 15 to the anode of the light emitting element E, a P-channel light emitting control transistor TEL for determining whether or not to supply the driving current to the light emitting element E is provided. In the embodiment, the light emitting control transistor TEL is provided between the first node ND1 (drain of the driving transistor TDR) and the anode of the light emitting element E. The gate of each of the light emitting control transistors TEL of the n pixel circuits P belonging to the i-th row is commonly connected to the light emitting control line 150 of the i-th row.

The P-channel transistor Tr is provided between the gate and the drain of the driving transistor TDR. The gate of the transistor Tr is commonly connected to the gate of the initialization transistor TIN. That is, the transistor Tr is controlled to be turned on or off according to the control signal GINI[i] output to the control line 130 in the same manner as the initialization transistor TIN.

The third capacitance element C3 is provided between the gate of the driving transistor TDR and the selection transistor TSL. The third capacitance element C3 is provided with a third electrode L3 connected to the selection transistor TSL and a fourth electrode L4 connected to the gate of the driving transistor TDR.

One end of the P-channel reset transistor TRES is connected to the third electrode L3 of the third capacitance element C3 through the initialization transistor TIN, and the other end is connected to the fourth electrode L4 of the third capacitance element C3 through the transistor Tr. The gate of each of the reset transistors TRES of the n pixel circuits P belonging to the i-th row is commonly connected to the reset line 140 of the i-th row. Accordingly, in the period when the initialization transistor TIN and the transistor Tr are kept in a turned-on state, when the reset signal GRES[i] is transited to the active level (low level), the reset transistor TRES is turned on, and the third electrode L3 and the fourth electrode L4 are short-circuited.

Next, paying attention to the j-th pixel circuit P of the i-th row, an operation (method of driving the pixel circuit P) of the driving circuit 20 will be described with reference to FIG. 10. Hereinafter, similarly to the first embodiment, an operation of the driving circuit 20 will be described by division into the initialization period PRS, the current set period PS, the writing period PWR, and the light emitting period PDR.

(a) Initialization Period PRS

Figure 10:
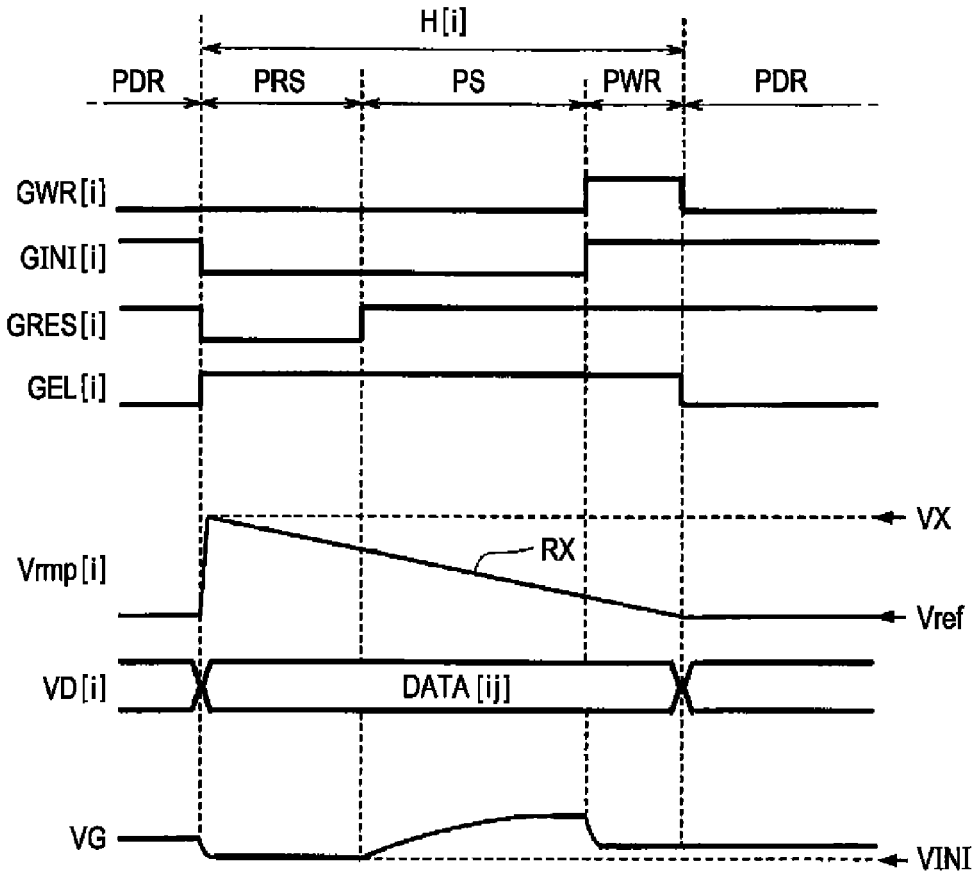
FIG. 10 is a timing chart illustrating an operation of the pixel circuit.
Figure 11:
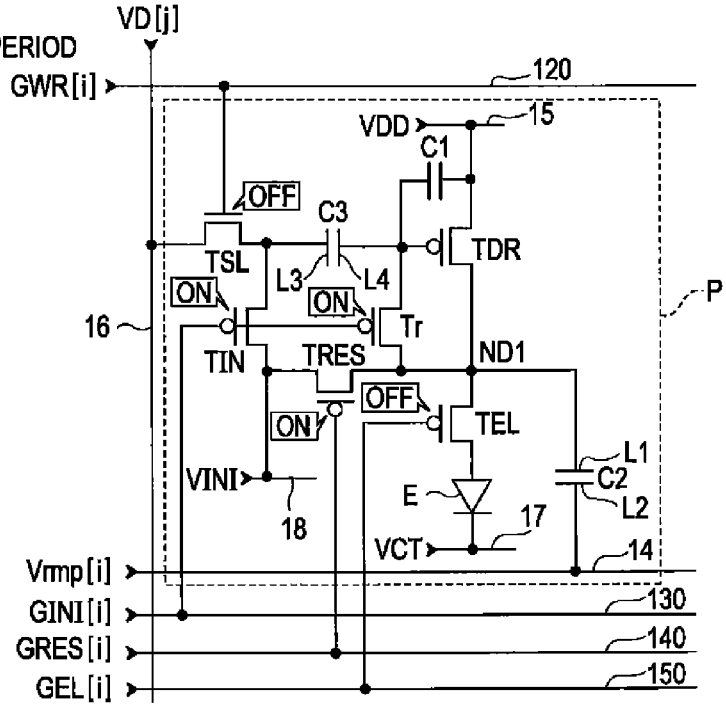
FIG. 11 is a diagram illustrating an operation of the pixel circuit at an initialization period.

As shown in FIG. 10, when the initialization period PRS is started, the driving circuit 20 (e.g., the scanning line driving circuit 21) sets the scanning signal GWR[i] to an inactive level (low level). Accordingly, as shown in FIG. 11, the N-channel selection transistor TSL is set to be turned off. As shown in FIG. 10, the driving circuit 20 sets the control signal GINI[i] and the reset signal GRES[i] to the active level (low level). Accordingly, as shown in FIG. 11, the initialization transistor TIN, the transistor Tr, and the reset transistor TRES are set to be turned on. Accordingly, since the third electrode L3 and the fourth electrode L4 of the third capacitance element C3 are electrically connected through the initialization transistor TIN, the reset transistor TRES, and the transistor Tr, the charges accumulated in the third capacitance element C3 at the time point just before the initialization period PRS are completely removed. Since the third electrode L3 is electrically connected to the initialization line 18 through the initialization transistor TIN, the potential of the third electrode L3 is set to the initialization potential VIM. Since the fourth electrode L4 is electrically connected to the initialization line 18 through the transistor Tr and the reset transistor TRES, the potential of the fourth electrode L4 is set to the initialization potential VINI. That is, the potential VG of the gate of the driving transistor TDR is set to the initialization potential VINI. The value of the initialization potential VINI is set to a level equal to or lower than the high supply potential VDD corresponding to the threshold voltage VTH of the driving transistor TDR. That is, the initialization potential VINI is a potential making the driving transistor TDR turn on when it is supplied to the gate of the driving transistor TDR.

As shown in FIG. 10, the driving circuit 20 sets the light emitting control signal GEL[i] to the inactive level (high level). Accordingly, as shown in FIG. 11, since the light emitting control transistor TEL is set to be turned off, the supply of the driving current to the light emitting element E enters a cutoff state. Therefore, the light emitting element E enters the non-light emitting state.

(b) Current Set Period PS

Figure 12:
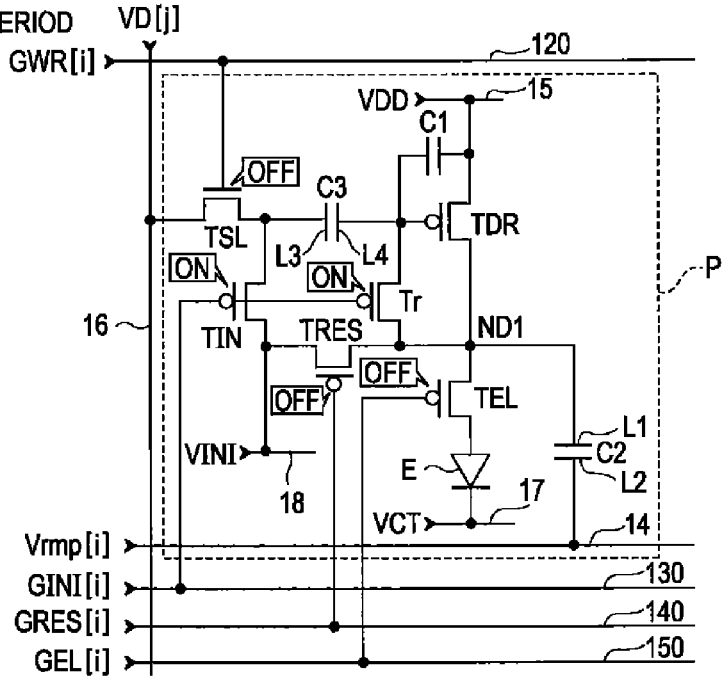
FIG. 12 is a diagram illustrating an operation of the pixel circuit at a current set period.

As shown in FIG. 10, when the current set period PS is started, the driving circuit 20 sets the reset signal GRES[i] to the inactive level (high level). The same level as the initialization period PRS is kept for the other signals. Accordingly, as shown in FIG. 12, the reset transistor TRES is turned off. Then, the third electrode L3 connected to the initialization line 18 through the initialization transistor TIN is kept in the initialization potential VINI, the driving transistor TDR is connected to the diode, and the potential VG of the gate of the driving transistor TDR rises with the passage of time. At this time, the driving circuit 20 linearly reduces the ramp potential Vrmp[i] output to the supply line 14 of the i-th row at the time rate of change RX, and generates the set current Is with a predetermined magnitude. This is the same as the first embodiment. Accordingly, at the end point of the current set period PS, the voltage between the gate and the source of the driving transistor TDR is set to voltage necessary for the constant set current Is to flow in the driving transistor TDR.

(c) Writing Period PWR

Figure 13:
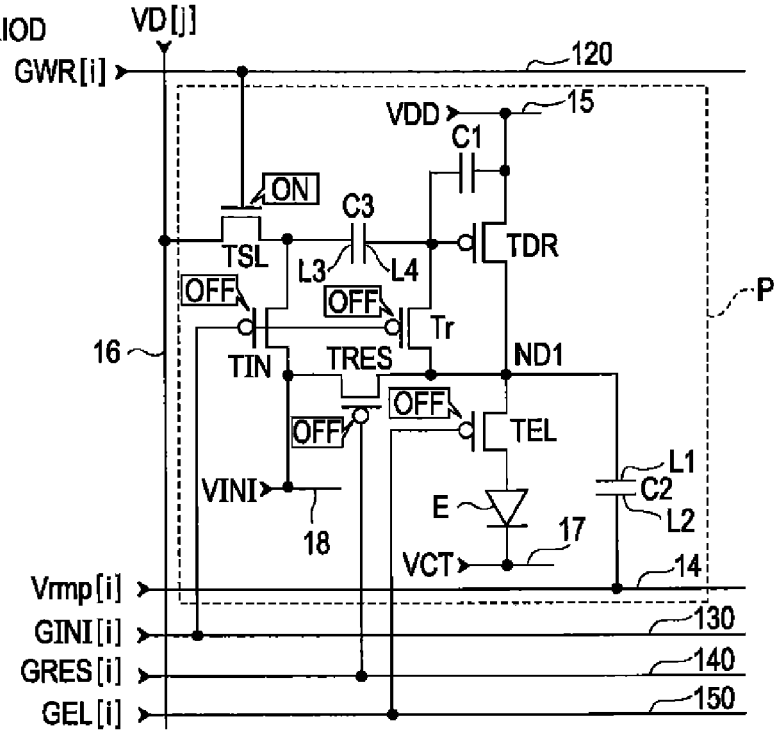
FIG. 13 is a diagram illustrating an operation of the pixel circuit at a writing period.

As shown in FIG. 10, when the writing period PWR is started, the driving circuit 20 sets the scanning signal GWR[i] to the active level (in this case, high level), and sets the control signal GINI[i] to the inactive level (high level). The same level as the current set period PS is kept for the other signals. Accordingly, as shown in FIG. 13, the selection transistor TSL is set to be turned on, and the initialization transistor TIN and the transistor Tr are set to be turned off. Therefore, since the data line 16 and the third electrode L3 are electrically connected through the selection transistor TSL, the potential of the third electrode L3 is changed to the data potential VD[j] (DATA[i, j]) output from the potential VINI set in the current set period PS to the data line 16 of the j-th column.

In the writing period PWR, the transistor Tr is in the turn-off state, impedance of the gate of the driving transistor TDR is sufficiently high. Accordingly, the gate (the fourth electrode L4) of the driving transistor TDR is in the electrically floating state. Accordingly, when the potential of the third electrode L3 is changed from the potential VINI in the current set period PS to the data potential VD[j] corresponding to variation ΔVx (=VINI−DATA[I, j]), the potential of the fourth electrode L4 is changed from the potential (potential corresponding to the set current Is) just therebefore. The fluctuation of the potential of the fourth electrode L4 at this time is determined according to a ratio of the third capacitance element C3 and the other capacitance (e.g., the capacitance of the first capacitance element C1, the capacitance of the gate of the driving transistor TDR, and the capacitance according to the other lines). That is, the potential VG of the gate of the driving transistor TDR is set to the potential corresponding to the data potential VD[j]. At this time, similarly to the current set period PS, since the driving circuit 20 (the potential generating circuit 25) linearly decreases the ramp potential Vrmp [i] output to the supply line 14 of the i-th row at the time rate of change RX, the constant set current Is continues to flow in the driving transistor TDR.

(d) Light Emitting Period PDR

Figure 14:
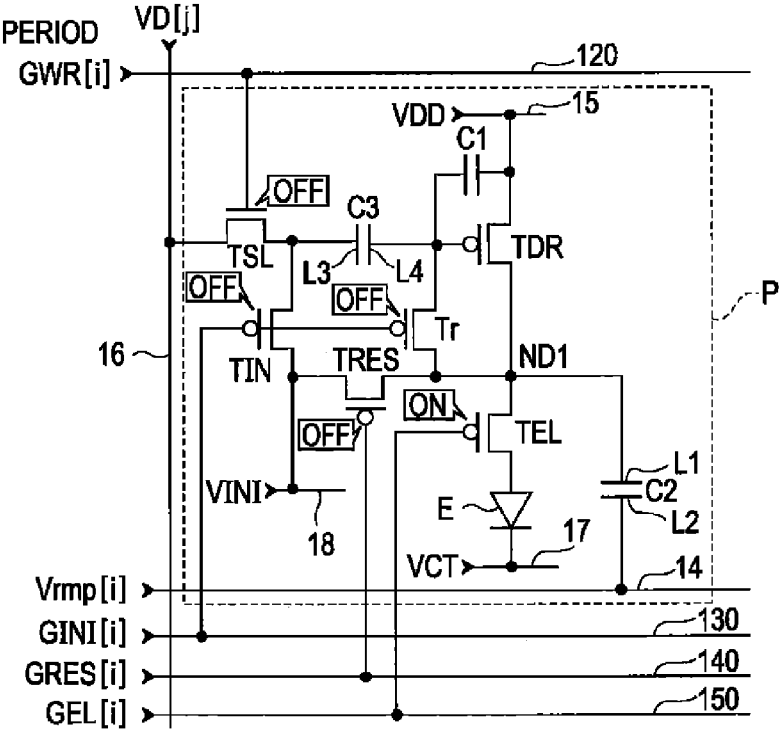
FIG. 14 is a diagram illustrating an operation of the pixel circuit at a light emitting period.

As shown in FIG. 10, when the light emitting period PDR is started, the driving circuit 20 sets the scanning signal GWR [i] to the inactive level (in this case, low level), and sets the light emitting control signal GEL[i] to the active level (in this case, low level). Accordingly, as shown in FIG. 14, the selection transistor TSL is set to be turned off, and the light emitting control transistor TEL is set to be turned on. As shown in FIG. 10, since the driving circuit 20 sets the ramp potential Vrmp[i] output to the supply line 14 of the i-th row to the constant reference potential Vref, the value of the set current Is becomes zero as can be seen from the formula (1).

In the light emitting period PDR, since the light emitting control transistor TEL is turned on, the path of the driving current is formed. Accordingly, the driving current corresponding to the potential of the gate of the driving transistor TDR is supplied from the high potential supply line 15 to the light emitting element E through the driving transistor TDR and the light emitting control transistor TEL. Therefore, the light emitting element E emits light by brightness corresponding to the driving current.

Also in the second embodiment described above, in the current set period PS just before the writing period PWR, the driving circuit 20 changes the ramp potential Vrmp[i] output to the supply line 14 of the i-th row with the passage of time such that the set current Is with the predetermined magnitude flows in the driving transistor TDR, to set the voltage (voltage between both ends of the first capacitance element C1) between both ends of the driving transistor TDR to the value necessary for the set current Is to flow in the driving transistor TDR. Accordingly, it is possible to drastically shorten the length of time necessary to set the voltage between the gate and the source of the driving transistor TDR just before the writing period PWR to a desired value, as compared with the related example.

C: Modified Example

The invention is not limited to the embodiments, and for may be modified, for example, as follows. Two or more modified examples of modified examples described below may be combined.

(1) Modified Example 1

Figure 15:
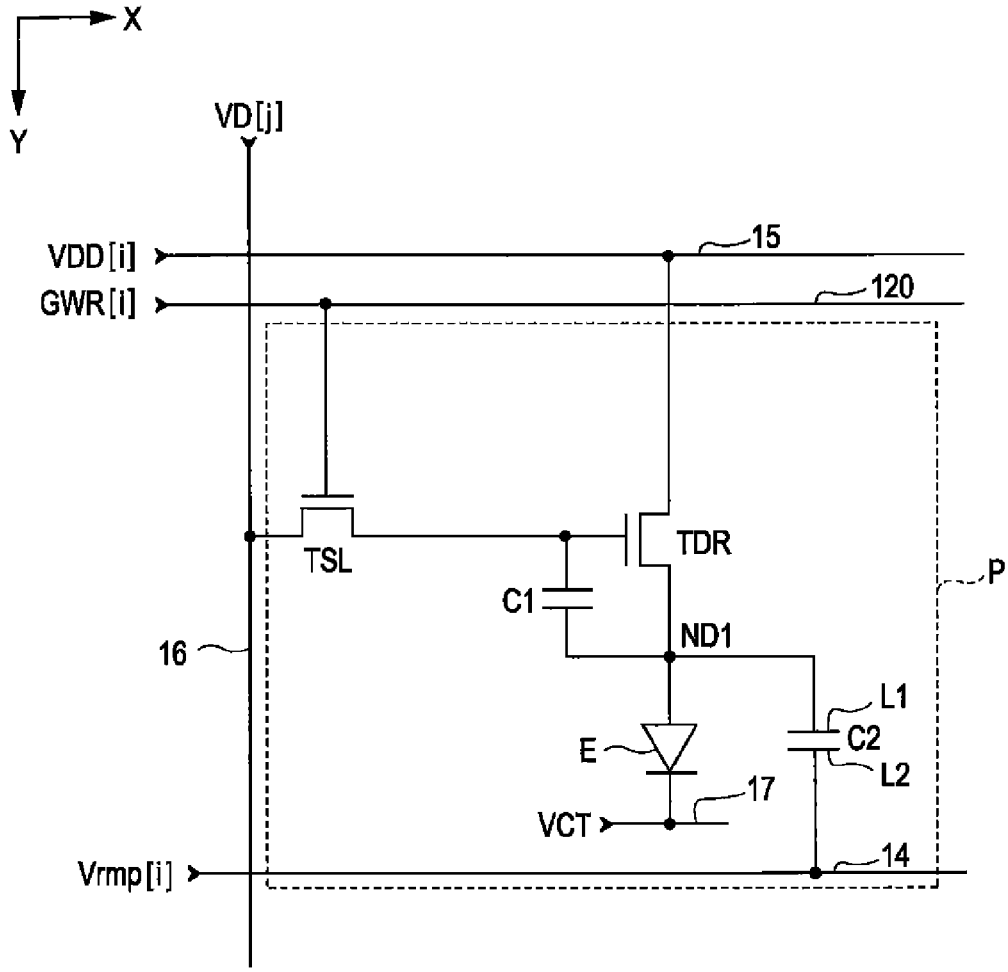
FIG. 15 is a circuit diagram illustrating a pixel circuit according to a modified example of the invention.

The configuration of the pixel circuit P is not limited to the aspect of FIG. 2 and FIG. 9, and is arbitrary. For example, the configuration of the pixel circuit P may be an aspect shown in FIG. 15. The aspect shown in FIG. 15 is different from the first embodiment described above in that the initialization line 18 and the initialization transistor TIN are not provided, and the initialization potential VIM and the data potential VD[j] are output to the data line 16 in time series. The other configuration is the same as the first embodiment, and the description of the repeated parts is omitted. Hereinafter, paying attention to the j-th pixel circuit P of the i-th row, an operation of the driving circuit 20 will be described by division into the initialization period PRS, the current set period PS, the writing period PWR, and the light emitting period PDR with reference to FIG. 16.

Figure 16:
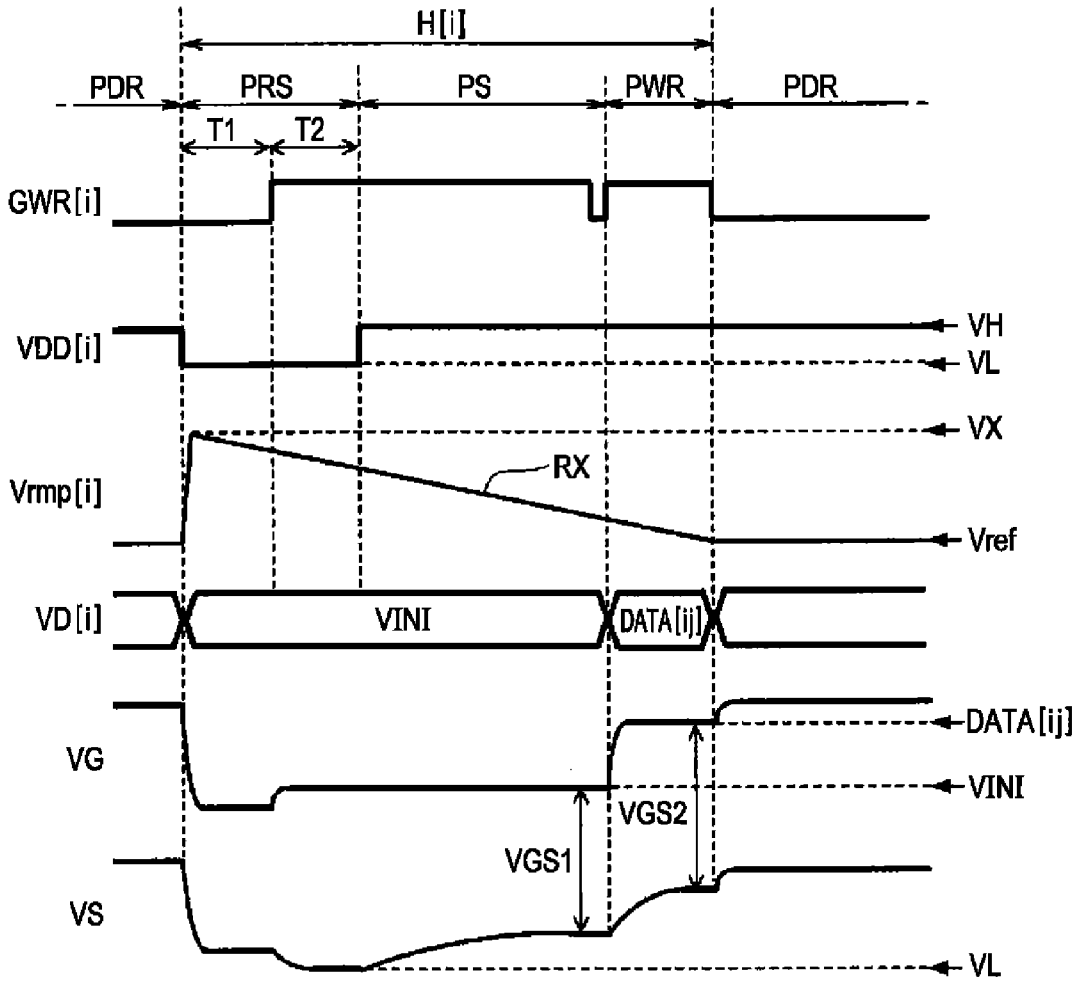
FIG. 16 is a timing chart illustrating an operation of the pixel circuit.

First, an operation of the driving circuit 20 in the initialization period PRS will be described. As shown in FIG. 16, the preparation period T1 is started, the driving circuit 20 sets the potential output to the data line 16 of the j-th column to the initialization potential VINI. The other operation is the same as the first embodiment. Subsequently, when the reset period T2 is started, the driving circuit 20 sets the scanning signal GWR[i] to the high level. The same level as the preparation period T1 is kept for the other signals. Accordingly, the selection transistor TSL is set to be turned on. Since the gate of the driving transistor TDR is electrically connected to the data line 16 through the selection transistor TSL, the potential VG of the gate of the driving transistor TDR is set to the initialization potential VINI output to the data line 16. Accordingly, the voltage between the gate and the source of the driving transistor TDR is initialized into the voltage (|VINI−VL|) of the difference between the initialization potential VINI and the low potential VL.

Next, an operation of the driving circuit 20 in the current set period PS will be described. As shown in FIG. 16, the driving circuit 20 keeps the scanning signal GWR[i] in the high level to the time just before the end point of the current set period PS. The driving circuit 20 keeps the potential output to the data line 16 in the current set period PS in the initialization potential VINI. The other operation is the same as the first embodiment, and at the end point of the current set period PS, the voltage between the gate and the source of the driving transistor TDR is set to the voltage VGS1 necessary for the constant set current Is to flow in the driving transistor TDR.

An operation of the driving circuit 20 in the writing period PWR is the same as the first embodiment. That is, the voltage between the gate and the source of the driving transistor TDR at the end point of the writing period PWR is set to the voltage VGS2 to which the data potential VD[j] and the characteristic (mobility μ) of the driving transistor TDR are applied. An operation of the driving circuit 20 in the light emitting period PDR is also the same as the first embodiment, and the driving current Iel corresponding to the voltage VGS2 at the end point of the writing period PWR flows in the light emitting element E, and the light emitting element E is in the light emitting state. Also in this aspect, in the current set period PS just before the writing period PWR, the driving circuit 20 changes the ramp potential Vrmp[i] with the passage of time such that the set current Is with a predetermined magnitude flows in the driving transistor TDR, to set the voltage between both ends of the driving transistor TDR to the value necessary for the set current Is to flow in the driving transistor TDR. Accordingly, it is possible to drastically shorten the length of time necessary to set the voltage between the gate and the source of the driving transistor TDR just before the writing period PWR to a desired value, as compared with the related example.

(2) Modified Example 2

In the embodiments described above, in the current set period PS, the driving circuit 20 changes the ramp potential Vrmp[i] output to the supply line 14 of the i-th row with the passage of time (i.e., the amount of charges of the second capacitance element C2 is changed with the passage of time), to generate the set current Is with the predetermined magnitude, but the invention is not limited thereto. A constant current source may be provided to generate the set current Is with the predetermined magnitude, instead of the second capacitance element C2 and the supply line 14. In this aspect, when the current set period PS is started, the driving circuit 20 controls the constant current source to be turned on such that the set current Is with the predetermined magnitude flows in the driving transistor TDR. In the other period, the driving circuit 20 controls the constant current source to be turned off. In short, it is preferable that the light emitting device according to the invention is provided with a current generating unit generating the set current Is with the predetermined magnitude.

(3) Modified Example 3

In the embodiments described above, the potential output to the supply line 14 in the current set period PS is linearly decreased at the constant time rate of change RX, but the invention is not limited thereto. The form of change of the potential output to the supply line 14 in the current set period PS is arbitrary. For example, the waveform of the potential output to the supply line 14 in the current set period PS may be a curved shape. In short, it is preferable that the potential output to the supply line 14 in the current set period PS is changed with the passage of time such that the set current Is with the predetermined magnitude flows in the driving transistor TDR.

(4) Modified Example 4

In the embodiments described above, in the initialization period PRS, the driving circuit 20 linearly decreases the ramp potential Vrmp[i] output to the supply line 14 at the time rate of change RX, but the invention is not limited thereto. The potential of the supply line 14 in the initialization period PRS is arbitrary. For example, in the initialization period PRS, the driving circuit 20 may fix the potential output to the supply line 14 to potential with a predetermined magnitude.

(5) Modified Example 5

The light emitting element E may be an OLED element, and may be inorganic diode or an LED (Light Emitting Diode). The important point is that all elements emitting light according to the supply (application of electric field or supply of current) of electrical energy may be used as the light emitting element of the invention.

D: Applied Example

Figure 17:
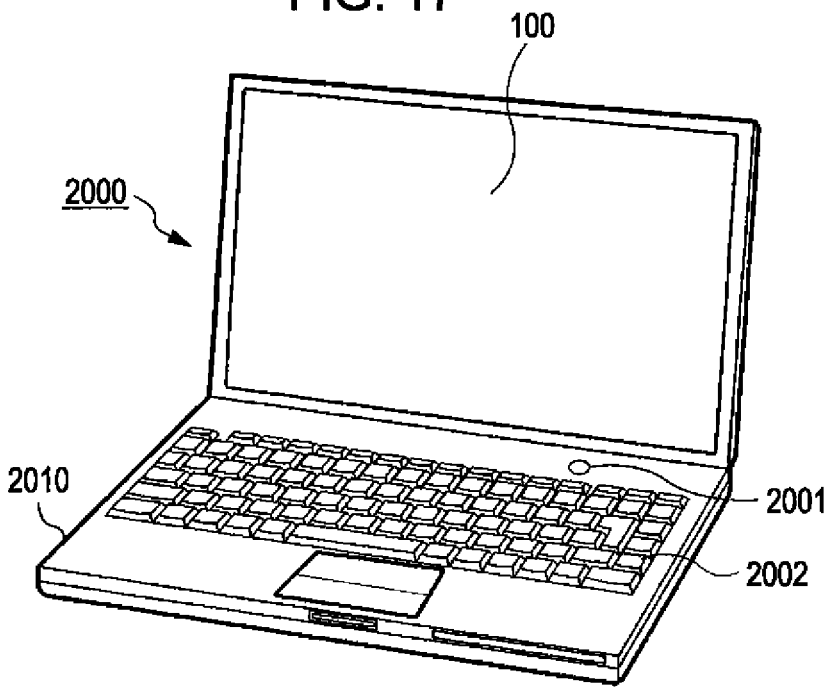
FIG. 17 is a perspective view illustrating a specific form of an electronic apparatus according to the invention.

Next, an electronic apparatus using the light emitting device according to the invention will be described. FIG. 17 is a perspective view illustrating a configuration of a mobile personal computer employing the light emitting device 100 according to the embodiments described above as a display device. The personal computer 2000 is provided with the light emitting device 100 as the display device and a main body unit 2010. The main body unit 2010 is provided with a power supply switch 2001 and a keyboard 2002. The light emitting device 100 uses an OLED element as the light emitting element E, and thus images can be displayed on an easily-visible screen with a wide viewing angle.

Figure 18:
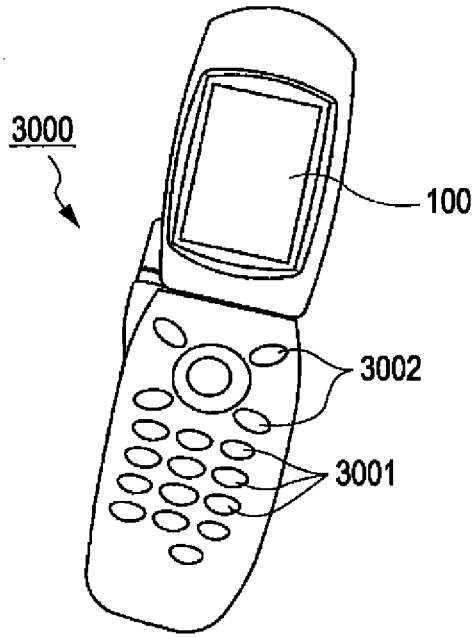
FIG. 18 is a perspective view illustrating a specific form of an electronic apparatus according to the invention.

FIG. 18 shows a configuration of a mobile phone employing the light emitting device 100 according to the embodiments described above as a display device. The mobile phone 3000 is provided with a plurality of operation buttons 3001, a scroll button 3002, and the light emitting device 100. The screen displayed on the light emitting device 100 is scrolled by operating the scroll button 3002.

Figure 19:
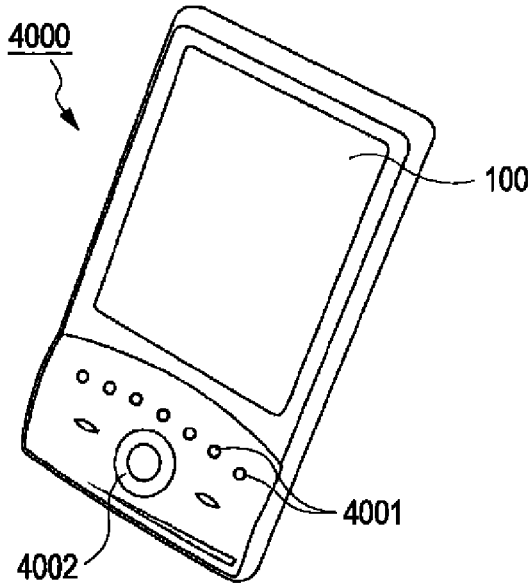
FIG. 19 is a perspective view illustrating a specific form of an electronic apparatus according to the invention.
Figure 20:
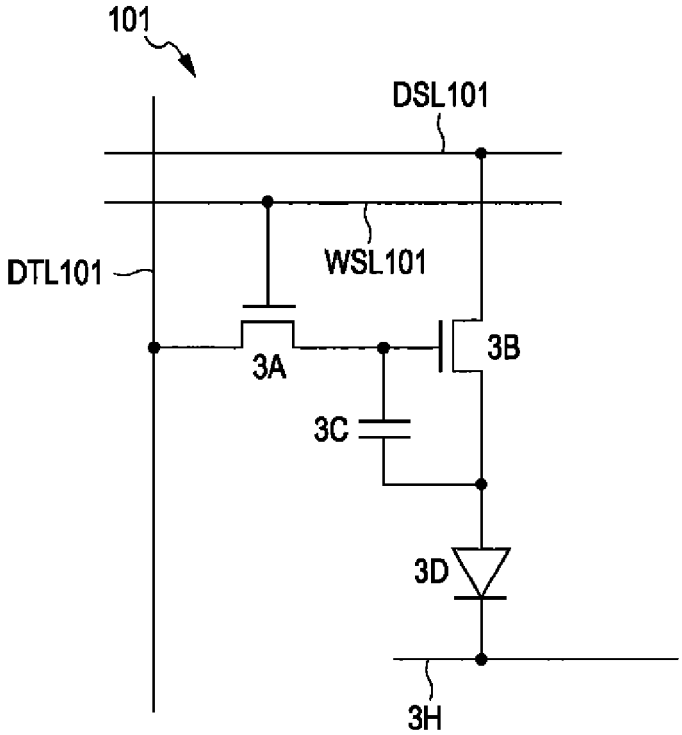
FIG. 20 is a circuit diagram illustrating a pixel circuit of the related art.
Figure 21:
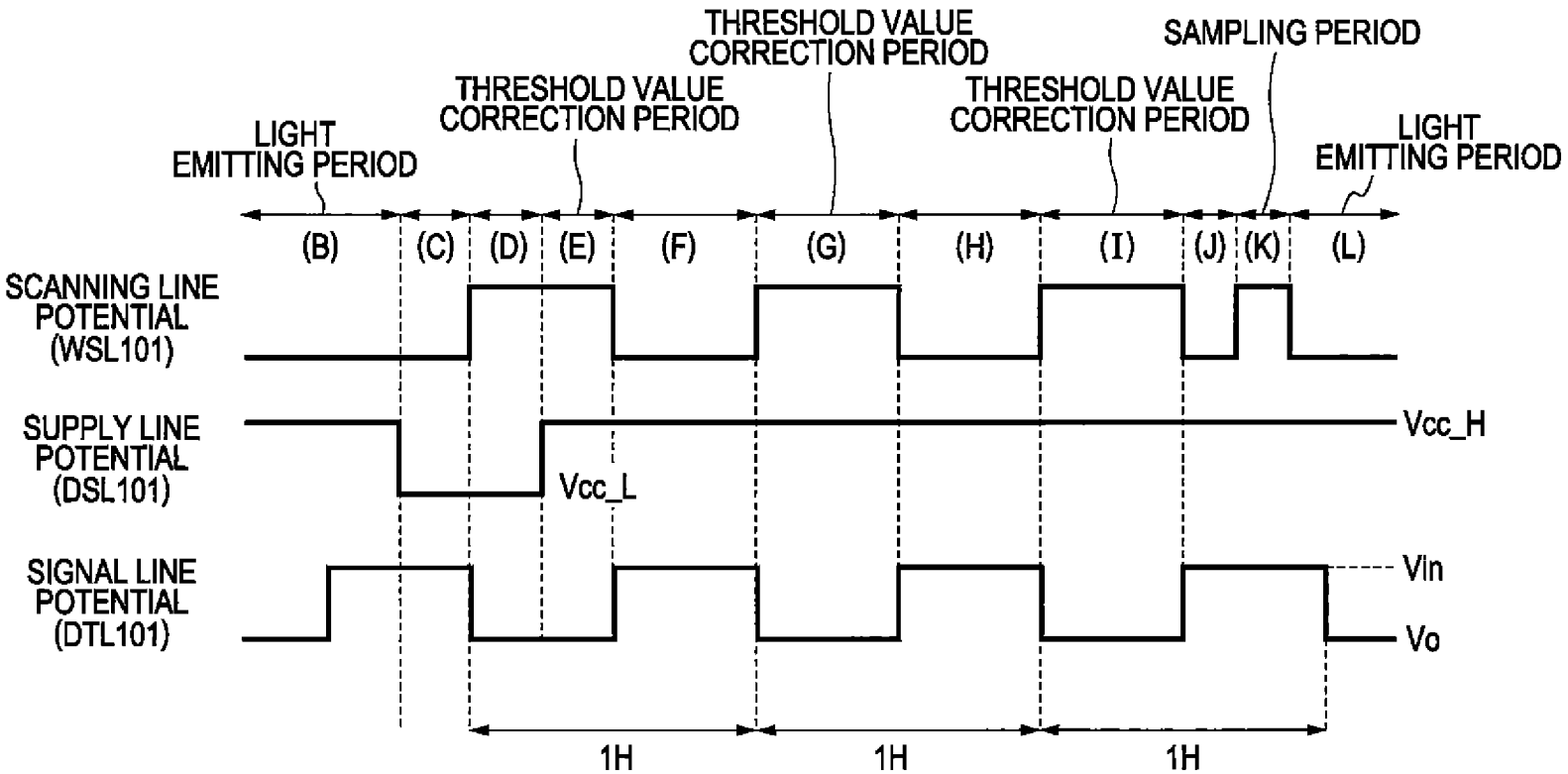
FIG. 21 is a timing chart illustrating an operation of the pixel circuit of the related art.

FIG. 19 shows a configuration of a mobile information terminal (PDA: Personal Digital Assistants) employing the light emitting device 100 according to the embodiments described above as a display device. The mobile information terminal 4000 is provided with a plurality of operation buttons 4001, a power supply switch 4002, and the light emitting device 100. When the power supply switch 4002 is operated, various kinds of information such as an address book and a schedule note are displayed on the light emitting device 100.

In addition to the apparatuses shown in FIG. 17 to FIG. 19, the electronic apparatus to which the light emitting device according to the invention is applied may be a digital still camera, a television, a video camera, a car navigation apparatus, a pager, an electronic notebook, an electronic paper, a calculator, a word processor, a work station, a video phone, a POS terminal, a printer, a scanner, a copier, a video player, an apparatus provided with a touch panel, and the like.

What is claimed is:

1. A light emitting device comprising:

a pixel circuit having a data line; and a driving circuit that drives the pixel circuit, wherein the pixel circuit includes a driving transistor and a light emitting element that are connected in series between a high potential supply line and a low potential supply line, a first capacitance element disposed between a gate and a source of the driving transistor, a selection transistor disposed between the gate of the driving transistor and the data line, and a current generating unit that generates a set current passing from the high potential supply line through the driving transistor and a node interposed between the driving transistor and the light emitting element, and flowing to be branched into the other path different from a path reaching the light emitting element, and wherein the driving circuit in a first period, is configured to set a potential of the gate of the driving transistor to an initialization potential to turn on the driving transistor, in a second period after the first period, is configured to control the current generating unit to generate the set current with a predetermined magnitude to set a voltage between both ends of the first capacitance element to a value sufficient for the set current to flow in the driving transistor, and in a third period after the second period, is configured to set the selection transistor to be turned on and to set a potential output to the data line to data potential corresponding to a designated gradation of the light emitting element to set the voltage between both ends of the capacitance element to a value corresponding to the data potential.

2. The light emitting device according to claim 1, wherein the current generating unit has a second capacitance element including a first electrode and a second electrode, and has a supply line, the first electrode is connected to the node, and the second electrode is connected to the supply line, and in the second period, the driving circuit is configured to change a potential output to the supply line with the passage of time to allow the set current with the predetermined magnitude to flow in the driving transistor.

3. The light emitting device according to claim 2, wherein in the second period, the potential output to the supply line is set to change linearly.

4. The light emitting device according to claim 1, wherein the current generating unit is formed of a constant current source.

5. An electronic apparatus comprising the light emitting device according to claim 1.

6. An electronic apparatus comprising the light emitting device according to claim 2.

7. An electronic apparatus comprising the light emitting device according to claim 3.

8. An electronic apparatus comprising the light emitting device according to claim 4.

9. A method of driving a pixel circuit including a driving transistor and a light emitting element that are connected in series between a high potential supply line and a low potential supply line, and a first capacitance element provided between a gate and a source of the driving transistor, the method comprising:

in a first period, setting potential of the gate of the driving transistor to initialization potential to turn on the driving transistor, in a second period after the first period, generating set current with a predetermined magnitude passing from the high potential supply line through the driving transistor and a node interposed between the driving transistor and the light emitting element, and flowing to be branched into the supply line, to set a voltage between both ends of the first capacitance element to a value in which the set current flows in the driving transistor, and in a third period after the second period, setting the potential of the gate of the driving transistor to potential corresponding to a designated gradation of the light emitting element.

10. A light emitting device comprising:

a pixel circuit and a driving circuit that drives the pixel circuit, the pixel circuit including a data line, a driving transistor and a light emitting element connected in series between a high potential supply line and a low potential supply line, a first capacitance element disposed between a gate and a source of the driving transistor, a selection transistor disposed between the gate of the driving transistor and the data line, and a current generating unit that generates a set current passing from the high potential supply line through the driving transistor and a node interposed between the driving transistor and the light emitting element, wherein the driving circuit in a first period, is configured to set a potential of the gate of the driving transistor to an initialization potential to turn on the driving transistor, in a second period after the first period, is configured to control the current generating unit to generate the set current with a predetermined magnitude to set a voltage between both ends of the first capacitance element to a value sufficient for the set current to flow in the driving transistor, and in a third period after the second period, is configured to set the selection transistor to be turned on and to set a potential output to the data line to data potential corresponding to a designated gradation of the light emitting element.

11. The light emitting device according to claim 10, wherein the current generating unit has a second capacitance element including a first electrode and a second electrode, and has a supply line, the first electrode is connected to the node, and the second electrode is connected to the supply line, and in the second period, the driving circuit is configured to change a potential output to the supply line with the passage of time to allow the set current with the predetermined magnitude to flow in the driving transistor.

12. The light emitting device according to claim 11, wherein in the second period, the potential output to the supply line is set to change linearly.

13. A light emitting device comprising:

a pixel circuit having a driving transistor and a light emitting element connected in series, and having a first capacitance element disposed between a gate and a source of the driving transistor; and a driving circuit that drives the pixel circuit, wherein the driving circuit is configured to sequentially (i) set a potential of a gate of the driving transistor to an initialization potential to turn on the driving transistor, (ii) set a voltage between both ends of the first capacitance element to a value sufficient for the set current to flow in the driving transistor, and (iii) set a potential output to the data line to data potential corresponding to a designated gradation of the light emitting element.

14. The light emitting device according to claim 13, wherein the pixel circuit has a second capacitance element including a first electrode and a second electrode, and has a supply line, and the driving circuit is configured to change a potential output when the voltage is set between both ends of the first capacitance element to a value sufficient for the set current to flow in the driving transistor.

15. The light emitting device according to claim 14, wherein the potential output to the supply line is set to change linearly.

* * * * *